US011525468B1

(12) United States Patent
Theriot et al.

(10) Patent No.: US 11,525,468 B1
(45) Date of Patent: Dec. 13, 2022

(54) BLOWOUT PREVENTER CLOSING CIRCUIT

(71) Applicant: Halliburton Energy Services, Inc., Houston, TX (US)

(72) Inventors: Mickie Theriot, Houma, LA (US); Robert Eugene Domann, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/486,006

(22) Filed: Sep. 27, 2021

(51) Int. Cl.

| | |
|---|---|
| ***F15B 15/20*** | (2006.01) |
| ***F15B 1/26*** | (2006.01) |
| ***F15B 1/04*** | (2006.01) |
| ***E21B 33/06*** | (2006.01) |

(52) U.S. Cl.
CPC ..... *F15B 15/20* (2013.01); *E21B 33/061* (2013.01); *F15B 1/04* (2013.01); *F15B 1/26* (2013.01)

(58) Field of Classification Search
CPC .... F15B 15/20; F15B 1/04; F15B 1/26; E21B 33/061
USPC ..... 166/344
See application file for complete search history.

(56) References Cited

U.S. PATENT DOCUMENTS 4,095,421 A * 6/1978 Silcox ..... E21B 33/064 166/344
4,185,652 A * 1/1980 Zintz ..... E21B 33/0355 251/25
4,442,902 A * 4/1984 Doremus ..... E21B 33/0355 166/374
6,192,680 B1 * 2/2001 Brugman ..... E21B 33/064 60/413
8,727,018 B1 * 5/2014 McCulloch ..... E21B 33/0355 166/375
2005/0178560 A1 * 8/2005 Johansen ..... E21B 23/04 166/374

(Continued)

FOREIGN PATENT DOCUMENTS

| | | |
|---|---|---|
| EP | 2118435 | 6/2012 |
| WO | 2013-009616 | 1/2013 |

OTHER PUBLICATIONS

International Search Report and Written Opinion for Application No. PCT/US2021/052699, dated Jun. 16, 2022.

*Primary Examiner* — Matthew R Buck
*Assistant Examiner* — Patrick F Lambe
(74) *Attorney, Agent, or Firm* — Thomas Rooney; C. Tumey Law Group PLLC

(57) ABSTRACT

The disclosure provides a blowout preventer system including: a hydraulic circuit, a blowout preventer including a ram having an open port and a close port, a hydraulic fluid tank, a hydraulic fluid pump, and a control valve. The hydraulic circuit includes: a first accumulator, a first valve, and a second valve. The control valve is coupled to the open port, the close port, and the hydraulic fluid tank. The first accumulator is coupled to the control valve by way of the first valve and to the close port by way of the second valve. The first valve allows hydraulic fluid to flow from the control valve to the first accumulator but prevents hydraulic fluid from flowing back to the control valve. When the control valve is in the open position, the second valve is closed, and when the control valve is in the close position, the second valve is open.

20 Claims, 4 Drawing Sheets

(56) References Cited

U.S. PATENT DOCUMENTS

| | | | | |
|---|---|---|---|---|
| 2010/0084588 | A1* | 4/2010 | Curtiss, III | E21B 34/16 251/57 |
| 2012/0067589 | A1* | 3/2012 | Fenton | E21B 17/085 166/340 |
| 2015/0354309 | A1* | 12/2015 | Baugh | F04B 9/08 166/244.1 |
| 2016/0319622 | A1* | 11/2016 | McAuley | E21B 34/16 |
| 2017/0037702 | A1* | 2/2017 | Gaude | E21B 34/16 |
| 2017/0145773 | A1* | 5/2017 | van Wijk | F15B 1/02 |
| 2020/0080657 | A1 | 3/2020 | Smith, III et al. | |
| 2020/0300056 | A1* | 9/2020 | Buffarini | E21B 33/064 |

* cited by examiner

BLOWOUT PREVENTER CLOSING CIRCUIT

TECHNICAL FIELD OF THE INVENTION

The present disclosure relates generally to blowout preventers used in the oil and gas industry and, more particularly, to systems and methods for hydraulically operating a blowout preventer.

BACKGROUND

Hydrocarbons, such as oil and gas, are produced or obtained from subterranean reservoir formations that may be located onshore or offshore. The development of subterranean operations and the processes involved in removing hydrocarbons from a subterranean formation typically involve several different steps, for example, drilling a wellbore at a desired well site, treating the wellbore to optimize production of hydrocarbons, performing the necessary steps to produce the hydrocarbons from the subterranean formation, and pumping the hydrocarbons to the surface of the earth.

Subterranean reservoirs from which hydrocarbons are to be extracted are surrounded by pressurized formations. Drilling fluids, sometimes called drilling muds, are used, in part, to counteract the release of pressure from drilling through the pressurized formations to get to the reservoir. Specifically, the drilling fluids are used to apply a hydrostatic pressure to the formations during drilling as a means of counteracting the pressure released. However, some formations that are drilled through are over-pressurized compared to the surrounding formations, and the release of pressure from those formations can cause an imbalance in pressure. This imbalance in pressure can cause water, gas, or oil to infiltrate the wellbore and cause a phenomenon known as a "kick." If a kick is not promptly identified and addressed, it can quickly escalate into a "blowout," which is an uncontrolled release of crude oil and/or natural gas from the reservoir. To counteract kicks and prevent blowouts, blowout preventors ("BOPs") are incorporated at the surface of the well that is being drilled. BOPs are designed to shut in the well and prevent the release of crude oil and/or natural gas from the well. In addition to preventing a blowout when a kick occurs, BOPs may also be required if there is a wellsite fire or a wellsite or wellbore equipment failure. To respond to blowouts, wellsite fires, and wellsite or wellbore equipment failures, BOPs are designed to act as quickly as possible to shut in the well.

BOPs are used in both onshore and offshore drilling operations. BOPs are specialized equipment that are typically installed at the surface of wellbores in stacks with other blowout preventers of varying type and function in order to seal off the wellbore. The two main types of BOPs are annular BOPs and ram BOPs, both of which are actuated using pressurized hydraulic fluid. Existing systems include a hydraulic fluid tank connected to a four-way control valve by way of a first hydraulic hose. A second hydraulic hose is coupled to the control valve and a first hydraulic port on the BOP such that when the control valve is in the close position, hydraulic fluid flows to the first hydraulic port on the BOP from the hydraulic fluid tank and the pressure of the hydraulic fluid acts to close the BOP. Additionally, a third hydraulic hose is coupled to the control valve and a second hydraulic port on the BOP such that when the control valve is in the open position, hydraulic fluid flows to the second hydraulic port on the BOP from to the hydraulic fluid tank and the pressure of the hydraulic fluid acts to open the BOP. In these existing systems, the amount of time it takes to close the ram of the BOP is dependent on the amount of time it takes to supply flow and pressure up the hydraulic hoses to close the hydraulic rams and apply the requisite pressure on the ram of the BOP. Due to the small size of the hydraulic hoses, which are typically ⅜ or ½ inch hydraulic lines, the large distance between the hydraulic fluid tank and the BOP, and the back pressure on the BOP from the hydraulic fluid in the third hydraulic hose, current systems take longer than the time allowed per recognized standards to provide the flow hydraulic fluid and pressure required to completely close the BOP. The most common way to resolve this issue is to increase the flow rate of hydraulic fluid to the BOP by increasing the size of the valves, hydraulic hoses, and equipment that operates the BOP. However, increasing the size of these components and refitting the system is expensive and makes it more difficult to work with on the jobsite. Therefore, increasing the size of these components may not be an acceptable solution. Thus, there exists a need for an alternative hydraulic circuit that does not require replacing the existing hydraulic lines and valves while still being able to meet the requirements of the standards recognized by the industry.

Figure 1:
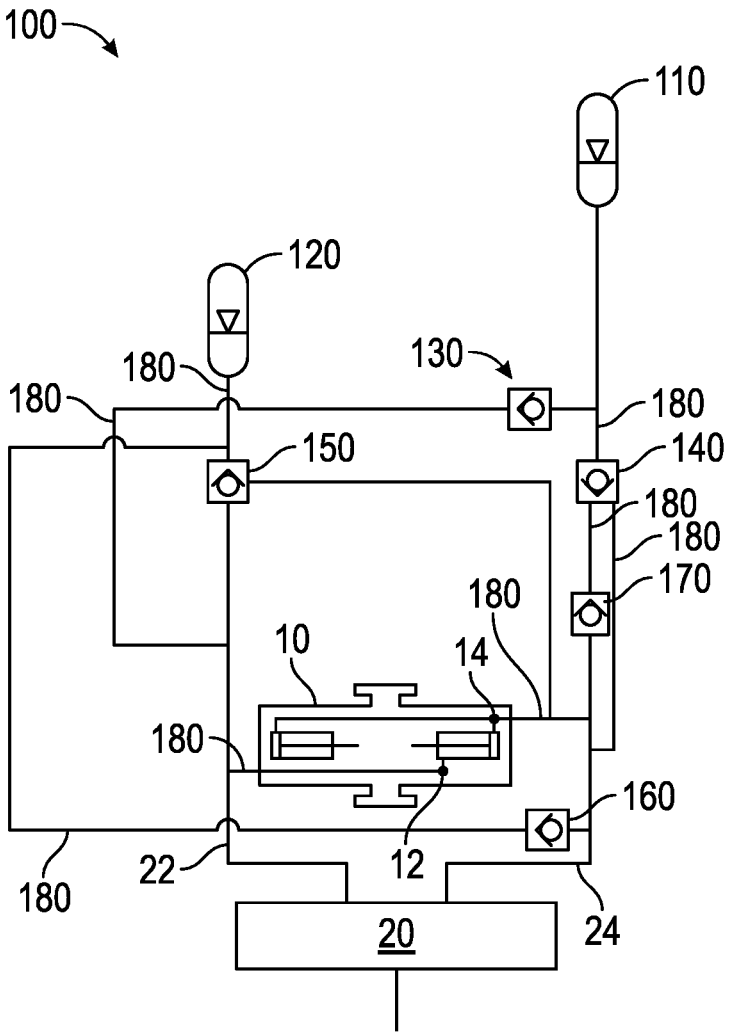
FIG. 1 is an illustrative hydraulic circuit for actuating a BOP according to one or more aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

A hydraulic circuit able to close a BOP within the required time using the existing BOPs and hydraulic circuits in the field is desired. In one or more embodiments, a high pressure accumulator and a low pressure accumulator may be incorporated into the BOP hydraulic circuit and physically coupled to or disposed adjacent to the BOP such that when closing the BOP, the requisite hydraulic flow and pressure may be provided to the BOP within the required time. The high pressure accumulator may be large enough to store sufficient pressurized hydraulic fluid to close the BOP and when wellsite conditions necessitate the operation of the BOP, a valve disposed between the BOP and the high pressure accumulator may be configured to open such that the pressurized hydraulic fluid stored in the high pressure accumulator is provided to the BOP ram. Additionally, the low pressure accumulator may be large enough to receive pressurized hydraulic fluid that passes through the BOP during closing of the BOP so as to minimize backpressure on the BOP during closing. In one or more embodiments, when wellsite conditions necessitate operation of the BOP, a valve disposed between the low pressure accumulator and the BOP ram may be configured to open such that hydraulic fluid on the back side of the BOP ram may flow into the low pressure accumulator, minimizing back pressure and increasing the closing speed of the BOP. After the ram is closed within the required time, the hydraulic circuit may be reset and the high pressure accumulator may be charged and the low pressure accumulator may be vented to ensure it is empty and the system is ready to close the BOP again when necessary. While, in one or more embodiments, the hydraulic circuit may be coupled to a BOP in order to close the BOP within a required time, in other embodiments, the hydraulic circuit may be coupled to any hydraulic actuator or cylinder that requires a flow of hydraulic fluid to actuate, such as a plug valve.

Illustrative embodiments of the present invention are described in detail herein. In the interest of clarity, not all features of an actual implementation may be described in this specification. It will of course be appreciated that in the development of any such actual embodiment, numerous implementation specific decisions may be made to achieve the specific implementation goals, which may vary from one implementation to another. Moreover, it will be appreciated that such a development effort might be complex and time consuming but would nevertheless be a routine undertaking for those of ordinary skill in the art having the benefit of the present disclosure.

The terms "couple" or "couples," as used herein are intended to mean either an indirect or direct connection. Thus, by way of example, if a first device couples to a second device, that connection may be through a direct physical connection or through an indirect connection by way of hydraulic hoses and/or valves.

FIG. 1 illustrates a hydraulic circuit 100 for actuating a BOP (not shown) according to one or more aspects of the present disclosure. While the hydraulic circuit 100 is illustrated in connection with a BOP, the hydraulic circuit 100 of the present disclosure may be used to actuate any hydraulic actuator or cylinder, such as plug valve, or any hydraulically activated wellhead pressure control equipment, such as that used in hydraulic workover units, drilling operations, wireline operations, flowback operations, and frac pumping operations. In one or more embodiments, any one or more components or elements may be used with subterranean operations equipment located on offshore platforms, drill ships, semi-submersibles, drilling barges and land-based rigs.

In one or more embodiments, the hydraulic circuit 100 may be fluidly coupled to a ram 10 of the BOP such that pressurized hydraulic fluid may be communicated to the ram, either closing the ram 10 to close off a wellbore, or opening the ram 10 to restore the system to its original state. In one or more embodiments, the ram 10 may perform a specific function within the BOP. By way of example only, the ram 10 the specific function may include restricting the flow of fluid between the wellbore and an outside of drill pipe, cutting off the opening for a tubing or drill string, and/or sealing the wellbore by cutting through the tubing or drill string. Further, the ram 10 may include an open port 12 and a close port 14. In one or more embodiments, the hydraulic circuit 100 may be coupled to both the open port 12 and the close port 14. Pressurized hydraulic fluid may either be communicated to the open port 12 to actuate the ram 10 to open it and/or keep it open or be communicated to the close port 14 to actuate the ram 10 to close it and/or keep it closed. By way of example only, industry standard BOPs may require up to 3000 psi to close the ram. However, depending on the BOP and tubing being used, the amount of pressure needed to actuate the ram can vary significantly.

Further, the hydraulic circuit 100 may be fluidly coupled to a hydraulic fluid tank (not shown) and a hydraulic fluid pump (not shown) by way of a two position four-way control valve 20. In one or more embodiments, the hydraulic pump may be configured to pump hydraulic fluid from the hydraulic fluid tank up to 3000 psi. However, in one or more embodiments, the hydraulic fluid pump may be configured to pump hydraulic fluid at any pressure as long as the pressure is greater than the pressure needed to close the ram 10 of the BOP. In one or more embodiments, the control valve 20 may be configured to switch between an open position and a close position. When the BOP is open or being opened, the control valve 20 may be configured to be in the open position, and when the BOP is closed or being closed, the control valve 20 may be configured to switch to the close position. In one or more embodiments, when the control valve 20 is in the open position, hydraulic fluid from the hydraulic fluid tank is configured to flow through the open side hydraulic hose 22 and be communicated to the open port 12 of the ram 10. Alternatively, when the control valve 20 is in the close position, hydraulic fluid from the hydraulic fluid tank is configured to flow through the close side hydraulic hose 24 and be communicated to the close port of the ram 10.

In one or more embodiments, the hydraulic circuit 100 may include a first accumulator 110, a second accumulator 120, a first valve 130, a second valve 140, a third valve 150, a fourth valve 160, and a plurality of hydraulic hoses 180. The first accumulator 110 may be a high pressure accumulator that, when wellbore operations are being run, is filled with pressurized hydraulic fluid, which can be used to quickly communicate pressurized hydraulic fluid to the close port 14 of the ram 10 of the BOP in the event that the ram 10 needs to be closed quickly. In one or more embodiments, the first accumulator 110 may be physically coupled to the BOP such that when closing the BOP, the requisite hydraulic pressure may be provided to the BOP within a required time to meet industry standards. Further, in one or more embodiments, the first accumulator 110 may be an accumulator with a capacity of from about 5 gallons to about 15 gallons. However, in other embodiments, the first accumulator may be any accumulator with a capacity at least 1.5 times the volume of hydraulic flow necessary to close the ram of the BOP which, by way of example, may be 1.9 gallons for a 5.12 inch BOP. Further, while a single accumulator is depicted, instead of a single accumulator, the first accumulator may be a plurality of accumulators of one or more sizes that provide the necessary capacity when each accumulator's capacity is added together.

In one or more embodiments, the first accumulator 110 may be coupled to the hydraulic fluid tank by way of one or more of the plurality of hydraulic hoses 180 and the open side hydraulic hose 22 such that when the control valve 20 is in the open position, hydraulic fluid flows to the first accumulator 110 and fills and pressurizes the first accumulator 110. The first valve 130 may be disposed between the first accumulator 110 and the open side hydraulic hose 22 such that when the control valve 20 is in the open position, hydraulic fluid may flow through the first valve 130 and into the first accumulator 110, but when the control valve 20 is in the close position, hydraulic fluid is prevented from flowing back through the first valve 130. In one or more embodiments, the first valve 130 may be a pilot operated check valve ("PO check valve"). However, in other embodiments, the first valve 130 may be a counterbalance valve, a hydraulic logic control valve, or a pilot operated directional valve.

Further, the first accumulator 110 may be coupled to the close port 14 of the ram 10 of the BOP by way of one or more of the plurality of hydraulic hoses 180 such that when the ram 10 of the BOP is closed, the pressurized hydraulic fluid stored in the first accumulator 110 may be communicated to the close port 14 to close the ram 10. The second valve 140 may be disposed between the first accumulator 110 and the ram 10 of the BOP. When the control valve 20 is in the open position, the second valve 140 may be closed so as to prevent the pressurized hydraulic fluid stored in the first accumulator 110 from being communicated to the close port 14 of the ram 10 and causing the ram 10 to close. Further, when the operator switches the control valve 20 to the close position to close the ram 10 of the BOP, the second valve 140 is opened to allow the pressurized hydraulic fluid stored in the first accumulator 110 to communicate with and provide pressurized hydraulic fluid to the close port 14 of the ram 10. In one or more embodiments, the second valve 140 may be a PO check valve. However, in other embodiments, the second valve 140 may be a counterbalance valve, a hydraulic logic control valve, or a pilot operated directional valve.

In one or more embodiments, the second accumulator 120 may be a low pressure accumulator that, when wellbore operations are being run, is kept empty, but that is able to receive return flow hydraulic fluid from the open port 12 of the ram 10 of the BOP when the control valve 20 is in the close position and the ram 10 is being closed. In one or more embodiments, the second accumulator 120 may be physically coupled to the BOP such that when closing the BOP, the second accumulator may receive return flow of hydraulic fluid from the open port 12 and relieve back pressure on the open port 12. In one or more embodiments, the second accumulator 120 may be an accumulator with a similar capacity to that of the first accumulator. However, as a low pressure accumulator, the second accumulator 120 may be smaller in capacity than the first accumulator 110. Thus, in one or more embodiments, the second accumulator 120 may be an accumulator with a capacity of at least 1 gallon. Furthermore, while a single accumulator is depicted, instead of a single accumulator, the second accumulator may be a plurality of accumulators of one or more sizes that provide a combined capacity of at least 1 gallon.

In one or more embodiments, the second accumulator 120 may be coupled to the open port 12 of the ram 10 of the BOP by way of one or more of the plurality of hydraulic hoses 180 such that when the ram 10 of the BOP is closing, the return flow of hydraulic fluid from the open port 12 of the ram 10 may be communicated to and fill the second accumulator 120 to relieve back pressure on the open port 12 of the ram 10. In one or more embodiments, the second accumulator 120 is coupled to the open port 12 by way of the same one or more of the plurality of hydraulic hoses 180 that couple the open side hydraulic hose 22 to the open port 12 of the ram 10. Further, in one or more embodiments, the third valve 150 may be disposed between the second accumulator 120 and both the ram 10 of the BOP and the open side hydraulic hose 22. Furthermore, the third valve 150 may be configured to be closed when the control valve 20 is in the open position so as to prevent hydraulic fluid from flowing to the second accumulator 120 and may be configured to be open when the control valve 20 is in the close position so as to allow hydraulic fluid to flow to the second accumulator 120. In one or more embodiments, the third valve 150 may be a PO check valve. However, in other embodiments, the third valve 150 may be a counterbalance valve, a hydraulic logic control valve, or a pilot operated directional valve. While a second accumulator is illustrated, in one or more embodiments, instead of using a second accumulator, a hydraulic hose of large diameter may be run directly from the third valve 150 to the hydraulic fluid tank to relieve back pressure on the open port 12 of the ram 10. Further, in one or more embodiments, the third valve need not be included either and the hydraulic hose of large diameter may be run directly from the open port 12 to the hydraulic fluid tank to relieve back pressure.

Further, the second accumulator 120 may be coupled to the hydraulic fluid tank by way of one or more of the plurality of hydraulic hoses 180 and the close side hydraulic hose 24 such that hydraulic fluid in the second accumulator 120 may be vented off. In one or more embodiments, the second accumulator 120 may begin venting off hydraulic fluid when the control valve 20 is in the close position after the ram 10 has finished closing, and the second accumulator 120 may vent off any remaining hydraulic fluid when the control valve is switched back to the open position, thus emptying the second accumulator 120. The fourth valve 160 may be disposed between the second accumulator 120 and the close side hydraulic hose 24 such that hydraulic fluid may flow through fourth valve 160 from the second accumulator 120 to the close side hydraulic hose 24 but is prevented from flowing from the close side hydraulic hose 24 back to the second accumulator 120. In one or more embodiments, the fourth valve 160 may be a PO check valve. However, in other embodiments, the fourth valve 160 may be a counterbalance valve, a hydraulic logic control valve, or a pilot operated directional valve.

Additionally, in one or more embodiments, the first accumulator 110 is coupled to the close port 14 of the ram 10 by way of the same one or more of the plurality of hydraulic hoses 180 that couple the close side hydraulic hose 24 to the close port 14 of the ram 10. In one or more embodiments, the hydraulic circuit 100 may further include a fifth valve 170, which may be disposed between the first accumulator 110 and both the ram 10 of the BOP and the close side hydraulic hose 24 so as to prevent hydraulic fluid from flowing back to the first accumulator 110 when the control valve 20 is in the close position and the pressure of the hydraulic fluid in the first accumulator 110 has equalized with the pressure of the hydraulic fluid flowing to the close port 14 from the hydraulic pump and the hydraulic fluid tank. More specifically, the fifth valve 170 may be disposed between the second valve 140 and both the ram 10 of the BOP and the close side hydraulic hose 24. Thus, when the control valve 20 is switched to the close position and the second valve 140 is opened, the pressurized hydraulic fluid stored in the first accumulator 110 may flow through the fifth valve 170 and communicate the pressurized hydraulic fluid of the first accumulator 110 to the close port 14 of the ram 10, but pressurized hydraulic fluid from the hydraulic fluid tank is prevented from flowing through the fifth valve 170 and into the first accumulator 110. In one or more embodiments, the fifth valve 170 may be a PO check valve. However, in other embodiments, the fifth valve 170 may be a counterbalance valve, a hydraulic logic control valve, or a pilot operated directional valve.

Figure 2:
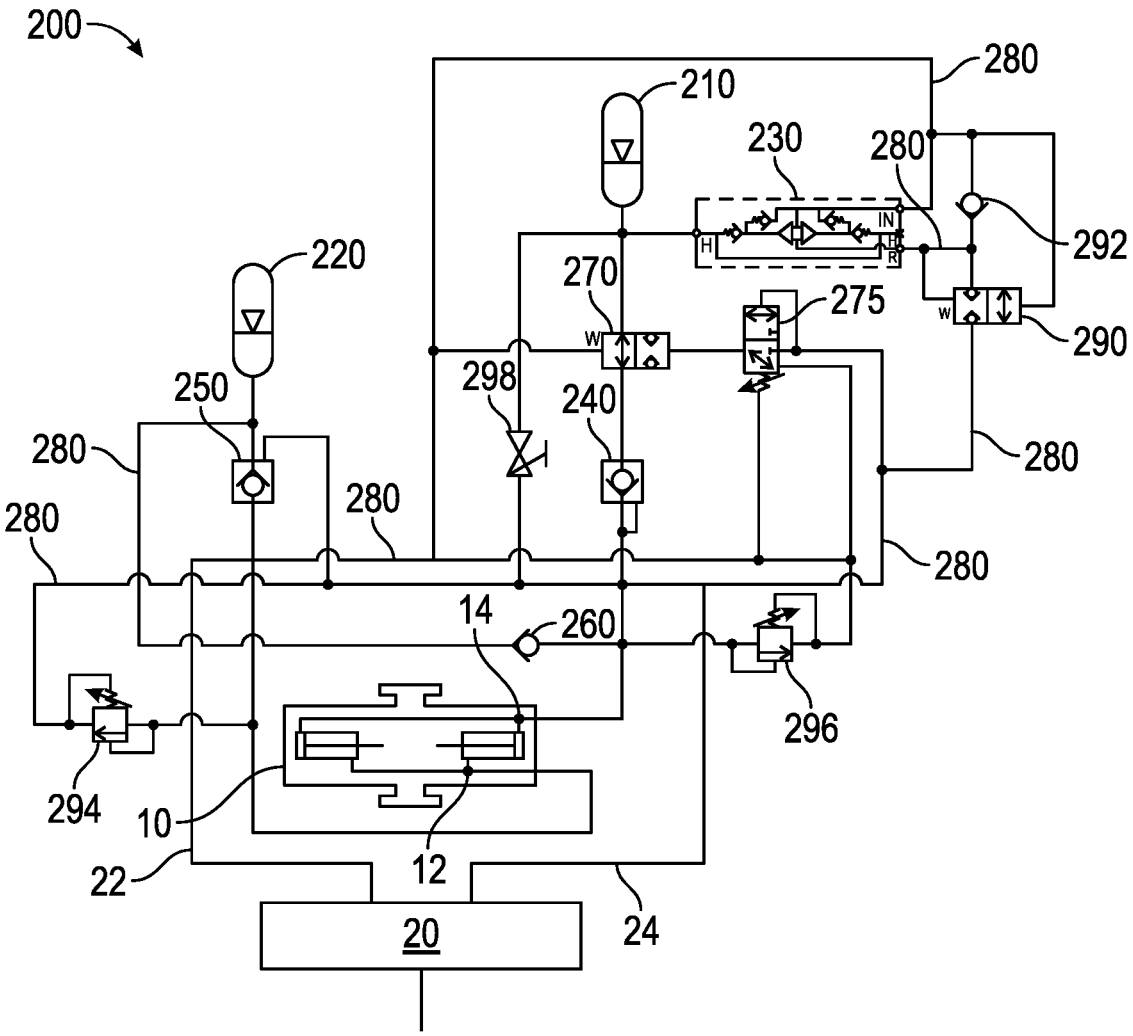
FIG. 2 is another illustrative hydraulic circuit for actuating a BOP according to one or more aspects of the present disclosure.

Now referring to FIG. 2, a hydraulic circuit 200 for actuating a BOP (not shown) according to one or more aspects of the present disclosure is illustrated. While the hydraulic circuit 200 is illustrated in connection with a BOP, the hydraulic circuit 200 of the present disclosure may be used to actuate any hydraulic actuator or cylinder, such as a plug valve, or any hydraulically activated wellhead pressure control equipment, such as that used in hydraulic workover units, drilling operations, wireline operations, flowback operations, and frac pumping operations. In one or more embodiments, any one or more components or elements may be used with subterranean operations equipment located on offshore platforms, drill ships, semi-submersibles, drilling barges and land-based rigs.

In one or more embodiments, the hydraulic circuit 200 may be fluidly coupled to a ram 10 of the BOP such that pressurized hydraulic fluid may be communicated to the ram, either closing the ram 10 to close off the wellbore, or opening the ram 10 to restore the system to its original state. In one or more embodiments, the ram 10 may perform a specific function within the BOP. By way of example only, the ram 10 the specific function may include restricting the flow of fluid between the wellbore and an outside of drill pipe, cutting off the opening for a tubing or drill string, and/or sealing the wellbore by cutting through the tubing or drill string. Further, the ram 10 may include an open port 12 and a close port 14. In one or more embodiments, the hydraulic circuit 200 may be coupled to both the open port 12 and the close port 14. Pressurized hydraulic fluid may either be communicated to the open port 12 to actuate the ram 10 to open it and/or keep it open or be communicated to the close port 14 to actuate the ram 10 to close it and/or keep it closed. By way of example only, industry standard BOPs may require up to 3000 psi to close the ram. However, depending on the BOP and tubing being used, the amount of pressure needed to actuate the ram can vary significantly.

Further, the hydraulic circuit 200 may be fluidly coupled to a hydraulic fluid tank (not shown) and a hydraulic fluid pump (not shown) by way of a two position four-way control valve 20. In one or more embodiments, the hydraulic pump may be configured to pump hydraulic fluid from the hydraulic fluid tank up to 3000 psi. However, in one or more embodiments, the hydraulic fluid pump may be configured to pump hydraulic fluid at any pressure as long as the pressure is greater than the pressure needed to close the ram 10 of the BOP. In one or more embodiments, the control valve 20 may be configured to switch between an open position and a close position. When the BOP is open or being opened, the control valve 20 may be configured to be in the open position, and when the BOP is closed or being closed, the control valve 20 may be configured to switch to the close position. In one or more embodiments, when the control valve 20 is in the open position, hydraulic fluid from the hydraulic fluid tank is configured to flow through the open side hydraulic hose 22 and be communicated to the open port 12 of the ram 10. Alternatively, when the control valve 20 is in the close position, hydraulic fluid from the hydraulic fluid tank is configured to flow through the close side hydraulic hose 24 and be communicated to the close port of the ram 10.

In one or more embodiments, the hydraulic circuit 200 may include a first accumulator 210, a second accumulator 220, a hydraulic intensifier 230, a first valve 290, a second valve 240, a third valve 250, a fourth valve 260, a fifth valve 270, a sixth valve 275, and a plurality of hydraulic hoses 280. The first accumulator 210 may be a high pressure accumulator that, when wellbore operations are being run, is filled with pressurized hydraulic fluid, which can be used to quickly communicate pressurized hydraulic fluid to the close port 14 of the ram 10 of the BOP in the event that the ram 10 is closed. In one or more embodiments, the first accumulator 210 may be physically coupled to the BOP such that when closing the BOP, the requisite hydraulic pressure may be provided to the BOP within a required time to meet industry standards. Further, in one or more embodiments, the first accumulator 210 may be an accumulator with a capacity of from about 5 gallons to about 15 gallons. However, in other embodiments, the first accumulator may be any accumulator with a capacity at least 1.5 times the volume of hydraulic flow necessary to close the ram of the BOP which, by way of example, may be 1.9 gallons for a 5.12 inch BOP. Further, while a single accumulator is depicted, instead of a single accumulator, the first accumulator may be a plurality of accumulators of one or more sizes that provide the necessary capacity when each accumulator's capacity is added together.

In one or more embodiments, the first accumulator 210 may be coupled to the hydraulic fluid tank by way of one or more of the plurality of hydraulic hoses 280 and the open side hydraulic hose 22 such that when the control valve 20 is in the open position, hydraulic fluid flows to the first accumulator 210 and fills and pressurizes the first accumulator 210. The hydraulic intensifier 230 may be disposed between the first accumulator 210 and the open side hydraulic hose 22 such that when the control valve 20 is in the open position, hydraulic fluid may flow through the hydraulic intensifier 230 and into the first accumulator 110, but when the control valve 20 is in the close position, hydraulic fluid is prevented from flowing back through the hydraulic intensifier 230. The hydraulic intensifier 230 may increase the pressure of the hydraulic fluid being provided by the hydraulic pump so that the hydraulic fluid stored in the first accumulator 210 is higher than the pressure provided by the hydraulic pump. By way of example only, in one or more embodiments, the pressure of the hydraulic fluid from the hydraulic pump may be 3000 psi, and the hydraulic intensifier may increase the pressure of the hydraulic fluid to 5000 psi. This rise in the pressure of the hydraulic fluid stored in the first accumulator 210 allows the system to communicate sufficient pressure and flow to the close port 14 of the ram 10 so as to ensure that the ram 10 closes within the required time.

Further, in one or more embodiments, in order to increase the pressure of the hydraulic fluid to be provided to the first accumulator 210, the hydraulic intensifier 230 must discharge a volume of hydraulic fluid. This discharged hydraulic fluid is communicated back to the close side hydraulic hose 24 by way of one or more of the plurality of hydraulic hoses 280. To prevent a flow of hydraulic fluid to the discharge side of the hydraulic intensifier 230 when the control valve is in the close position while allowing discharged hydraulic fluid from the hydraulic intensifier to return to the hydraulic circuit 200, the hydraulic circuit 200 may include a first valve 290. In one or more embodiments, the first valve 290 may be a normally closed valve. However, in other embodiments, the first valve 290 may be a check valve, a PO check valve, a counterbalance valve, a hydraulic logic control valve, or a pilot operated directional valve. The first valve may be disposed between the hydraulic intensifier 230 and close side hydraulic hose 24 such that the first valve 290 is open and hydraulic fluid discharged from the hydraulic intensifier 230 may flow through the first valve 290 to the close side hydraulic hose 24 when the control valve 20 is in the open position and the first accumulator 210 is being filled with pressurized hydraulic fluid, and the first valve 290 may be closed when the control valve is in the close position and the close side hydraulic hose is communicating pressurized hydraulic fluid to the close port 14 of the ram 10. In one or more embodiments, the first valve 290 may be fluidly coupled to a hydraulic hose 280 that is coupled to the open side hydraulic hose 22 by way of pilot pressure signal lines such that when the control valve 20 is in the open position, the pressure in the open side hydraulic hose 22 opens the first valve 290. Further, in one or more embodiments, when the control valve 20 is in the close position, the first valve may be configured to return to its default state and close due to the lack of pressure from the open side hydraulic hose 22. Additionally, in one or more embodiments, the hydraulic circuit 200 may include a check valve 292 which is disposed between the first valve 290 and the open side hydraulic hose 22 such that discharged hydraulic fluid may flow from the hydraulic intensifier to the open side hydraulic hose 22 through the check valve 292, but hydraulic fluid is prevented from flowing back form the open side hydraulic hose 22 to the first valve 290.

Furthermore, the first accumulator 210 may be coupled to the close port 14 of the ram 10 of the BOP by way of one or more of the plurality of hydraulic hoses 280 such that when the ram 10 of the BOP is closed, the pressurized hydraulic fluid stored in the first accumulator 210 may be communicated to the close port 14 to close the ram 10. The second valve 240 may be disposed between the first accumulator 210 and the ram 10 of the BOP. When the control valve 20 is in the open position, the second valve 240 may be closed so as to prevent the pressurized hydraulic fluid stored in the first accumulator 210 from being communicated to the close port 14 of the ram 10 and causing the ram 10 to close. Further, when the operator switches the control valve 20 to the close position to close the ram 10 of the BOP, the second valve 240 is opened to allow the pressurized hydraulic fluid stored in the first accumulator 210 to communicate with and provide pressurized hydraulic fluid to the close port 14 of the ram 10. In one or more embodiments, the second valve 240 may be a PO check valve. However, in other embodiments, the second valve 240 may be a counterbalance valve, a hydraulic logic control valve, or a pilot operated directional valve.

In one or more embodiments, the second accumulator 220 may be a low pressure accumulator that, when wellbore operations are being run, is kept empty, but that is able to receive return flow hydraulic fluid from the open port 12 of the ram 10 of the BOP when the control valve 20 is in the close position and the ram 10 is being closed. In one or more embodiments, the second accumulator 220 may be physically coupled to the BOP such that when closing the BOP, the second accumulator may receive return flow of hydraulic fluid from the open port 12 and relieve back pressure on the open port 12. In one or more embodiments, the second accumulator 220 may be an accumulator with a similar capacity to that of the first accumulator. However, as a low pressure accumulator, the second accumulator 220 may be smaller in capacity than the first accumulator 210. Thus, in one or more embodiments, the second accumulator 220 may be an accumulator with a capacity of at least 1 gallon. Furthermore, while a single accumulator is depicted, instead of a single accumulator, the second accumulator may be a plurality of accumulators of one or more sizes that provide a combined capacity of at least 1 gallon.

In one or more embodiments, the second accumulator 220 may be coupled to the open port 12 of the ram 10 of the BOP by way of one or more of the plurality of hydraulic hoses 280 such that when the ram 10 of the BOP is closing, the return flow of hydraulic fluid from the open port 12 of the ram 10 may be communicated to and fill the second accumulator 220 to relieve back pressure on the open port 12 of the ram 10. In one or more embodiments, the second accumulator 220 is coupled to the open port 12 by way of the same one or more of the plurality of hydraulic hoses 280 that couple the open side hydraulic hose 22 to the open port 12 of the ram 10. Further, in one or more embodiments, the third valve 250 may be disposed between the second accumulator 220 and both the ram 10 of the BOP and the open side hydraulic hose 22. Furthermore, the third valve 250 may be configured to be closed when the control valve 20 is in the open position so as to prevent hydraulic fluid from flowing to the second accumulator 220 and may be configured to be open when the control valve 20 is in the close position so as to allow hydraulic fluid to flow to the second accumulator 220. In one or more embodiments, the third valve 250 may be a PO check valve. However, in other embodiments, the third valve 250 may be a counterbalance valve, a hydraulic logic control valve, or a pilot operated directional valve. While a second accumulator is illustrated, in one or more embodiments, instead of using a second accumulator, a hydraulic hose of large diameter may be run directly from the third valve 250 to the hydraulic fluid tank to relieve back pressure on the open port 12 of the ram 10. Further, in one or more embodiments, the third valve need not be included either and the hydraulic hose of large diameter may be run directly from the open port 12 to the hydraulic fluid tank to relieve back pressure.

Further, the second accumulator 220 may be coupled to the hydraulic fluid tank by way of one or more of the plurality of hydraulic hoses 280 and the close side hydraulic hose 24 such that hydraulic fluid in the second accumulator 220 may be vented off. In one or more embodiments, the second accumulator 220 may begin venting off hydraulic fluid when the control valve 20 is in the close position after the ram 10 has finished closing, and the second accumulator 220 may vent off any remaining hydraulic fluid when the control valve is switched back to the open position, thus emptying the second accumulator 220. The fourth valve 260 may be disposed between the second accumulator 220 and the close side hydraulic hose 24 such that hydraulic fluid may flow through fourth valve 260 from the second accumulator 220 to the close side hydraulic hose 24 but is prevented from flowing from the close side hydraulic hose 24 back to the second accumulator 220. In one or more embodiments, the fourth valve 260 may be a PO check valve. However, in other embodiments, the fourth valve 260 may be a counterbalance valve, a hydraulic logic control valve, or a pilot operated directional valve.

Additionally, in one or more embodiments, because the hydraulic fluid stored in the first accumulator 210 is amplified above the pressure of the fluid provided by the hydraulic pump, the hydraulic circuit 200 may include a fifth valve 270 and a sixth valve 275 to prevent over-pressurization at the ram 10. The fifth valve 270 and the sixth valve 275 may work in tandem to stop flow of hydraulic fluid from the first accumulator 210 to the close port 14 of the ram 10 once the pressure at the close port 14 reaches the required pressure to close the ram. In one or more embodiments, the fifth valve 270 may be a normally open valve with a bias spring to open. In one or more embodiments, the fifth valve 270 may include the bias spring to maintain a default position. By way of example only, in one or more embodiments, the bias spring may be a 400 psi bias spring. Further, in one or more embodiments, the fifth valve 270 may be fluidly coupled between the first accumulator and the second valve 240 such that when the fifth valve 270 is open, hydraulic fluid from the first accumulator 210 flows to the second valve 240, and when the fifth valve 270 is closed, hydraulic fluid from the first accumulator 210 is prevented from reaching the second valve 210. Additionally, the fifth valve 270 may be fluidly coupled to a hydraulic hose 280 that is coupled to the open side hydraulic hose 22 on one side and to the sixth valve 275 on the other side by way of pilot pressure signal lines such that when the sixth valve 275 is open and the pressure in the close side hydraulic hose 24 is greater than the pressure in the open side hydraulic hose 22 by the amount needed to counteract the bias spring, the fifth valve 270 closes. Thus, when the control valve 20 is in the open position and the open side hydraulic hose 22 is pressurized, the fifth valve 270 will remain open, and when the control valve 20 is in the close position and the pressure in the close side hydraulic hose 24 reaches a predetermined value as discussed below with regard to the sixth valve 275, the fifth valve 270 closes.

The sixth valve 275 may be an adjustable valve that can be set to shift at a predetermined pressure. In one or more embodiments, the predetermined pressure may be set in the range of 2900 psi-3000 psi. However, in other embodiments, the predetermined pressure may be any pressure greater than the pressure required to close the ram 10 of the BOP. In its default position, the sixth valve 275 may allow pressurized hydraulic fluid from a hydraulic hose 280 coupled to the open side hydraulic hose 22 to communicate to the fifth valve 270 by way of a pilot pressure signal line disposed between the fifth valve 270 and the sixth valve 275. In one or more embodiments, the sixth valve 275 may be fluidly coupled to the open side hydraulic hose 22 by way of a pilot pressure signal line such that when the control valve 20 is in the open position, pressurized hydraulic fluid may communicate to the sixth valve 275 and maintain the sixth valve 275 in the default position. Further, in one or more embodiments, the sixth valve 275 may be fluidly coupled to the close side hydraulic hose 24 by way of a pilot pressure signal line such that when the pressure in the close side hydraulic hose 24 reaches the predetermined pressure, the sixth valve shifts from the default position to a second position in which pressurized hydraulic fluid from the close side hydraulic hose 24 may pass through the sixth valve 275 and communicate to the fifth valve 270. Thus, in one or more embodiments, when the pressure of the hydraulic fluid at the close port 14 of the ram 10 reaches the predetermined pressure, which is greater than or equal to the pressure required to close the ram 10, the sixth vale 275 shifts to the second position, causing the fifth valve 270 to close, preventing an over-pressurization at the close port 14 of the ram 10. While the hydraulic circuit 200 is illustrated including both a fifth valve 270 and a sixth valve 275, a single valve may be used in place of the fifth valve and sixth valve, where the single valve remains open until the hydraulic pressure at the close port 14 of the ram 10 has reached the pressure required to close the ram 10 and then the single valve closes to prevent over-pressurization at the close port 14 due to flow of highly pressurized hydraulic fluid from the first accumulator 210.

Further, in one or more embodiments, the hydraulic system 200 may further include a first safety relief valve 294, a second safety relief valve 296, and a manually-operated open/close valve 298. In one or more embodiments, the first safety relief valve 294 may be coupled between the open side hydraulic hose 22 and the close side hydraulic hose 24, either directly or indirectly by way of one or more of the plurality of hydraulic hoses 280, such that if pressure in the open side hydraulic hose 22 exceeds a predetermined pressure, the first safety relief valve 294 opens to relieve pressure and prevent over-pressurization at the open port 12 of the ram 10. Similarly, in one or more embodiments, the second safety relief valve 296 may be coupled between the close side hydraulic hose 24 and the open side hydraulic hose 22, either directly or indirectly by way of one or more of the plurality of hydraulic hoses 280, such that if pressure in the close side hydraulic hose 24 exceeds a predetermined pressure, the second safety relief valve 296 opens to relieve pressure and prevent over-pressurization at the close port 14 of the ram 10. In one or more embodiments, the first safety relief valve 294 and the second safety relief valve 296 may be a direct-acting, normally closed, pressure-limiting valve. However, the first safety relief valve 294 and the second safety relief valve 296 may be any valve that is set to open at a predetermined pressure in order to prevent over-pressurization of the hydraulic system 200. Additionally, by way of example only, in one or more embodiments, the predetermined pressure, at which the first safety relief valve 294 and the second safety relief valve 296 are set to open, may be set at 3300 psi.

Additionally, the manually-operated open/close valve 298 may be coupled between the first accumulator 210 and the close side hydraulic hose 14, and in the default position, may be closed. In one or more embodiments, if pressure needs to be relieved from the first accumulator without closing the ram 10 of the BOP or having already closed the ram 10 of the BOP, pressure may be bled from the first accumulator 210 by slowly, partially opening the manually-operated open/close valve 298.

Figure 3:
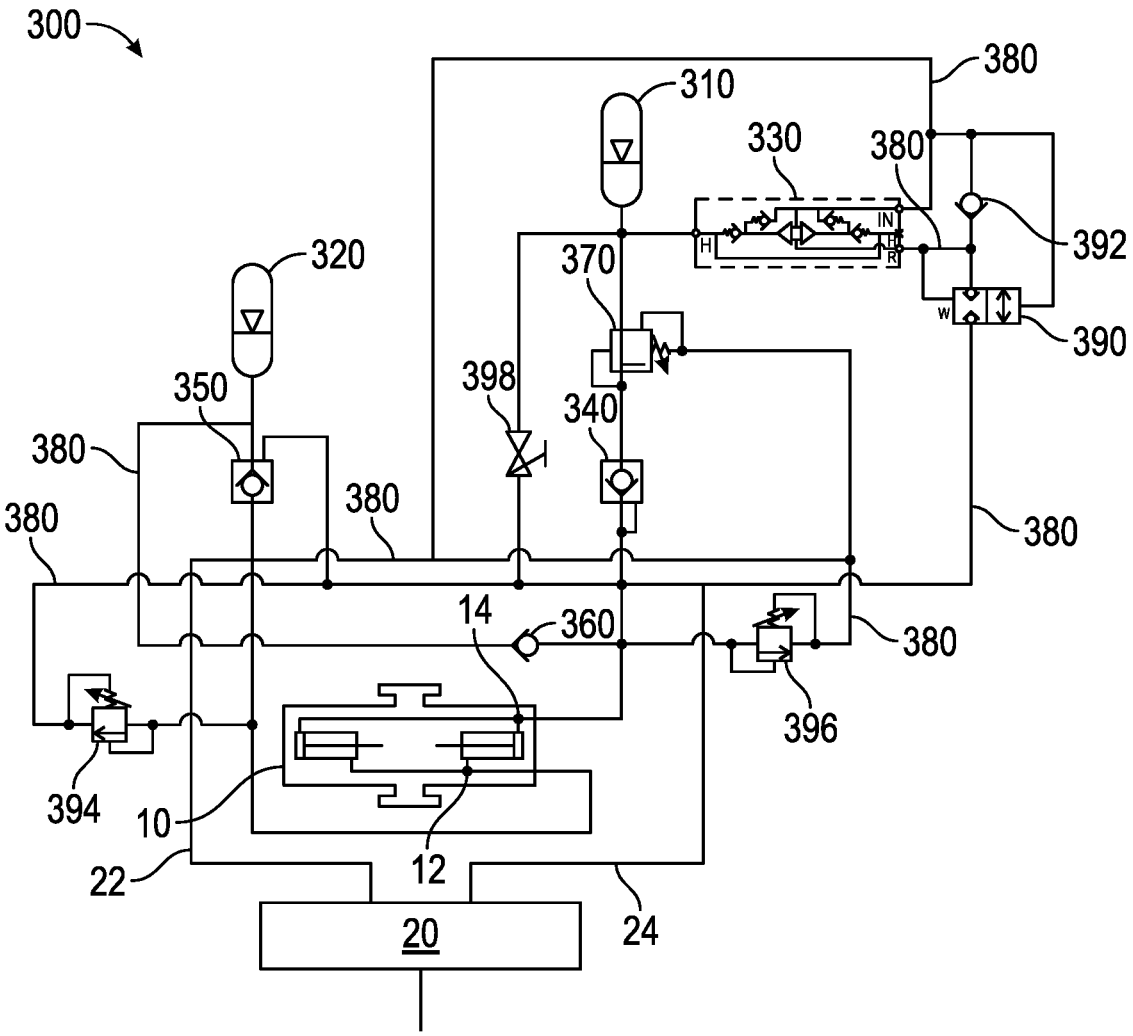
FIG. 3 is another illustrative hydraulic circuit for actuating a BOP according to one or more aspects of the present disclosure.

Now referring to FIG. 3, a hydraulic circuit 300 for actuating a BOP (not shown) according to one or more aspects of the present disclosure is illustrated. While the hydraulic circuit 300 is illustrated in connection with a BOP, the hydraulic circuit 300 of the present disclosure may be used to actuate any hydraulic actuator or cylinder, such as a plug valve, or any hydraulically activated wellhead pressure control equipment, such as that used in hydraulic workover units, drilling operations, wireline operations, flowback operations, and frac pumping operations. In one or more embodiments, any one or more components or elements may be used with subterranean operations equipment located on offshore platforms, drill ships, semi-submersibles, drilling barges and land-based rigs.

In one or more embodiments, the hydraulic circuit 300 may be fluidly coupled to a ram 10 of the BOP such that pressurized hydraulic fluid may be communicated to the ram, either closing the ram 10 to close off the wellbore, or opening the ram 10 to restore the system to its original state. In one or more embodiments, the ram 10 may perform a specific function within the BOP. By way of example only, the ram 10 the specific function may include restricting the flow of fluid between the wellbore and an outside of drill pipe, cutting off the opening for a tubing or drill string, and/or sealing the wellbore by cutting through the tubing or drill string. Further, the ram 10 may include an open port 12 and a close port 14. In one or more embodiments, the hydraulic circuit 300 may be coupled to both the open port 12 and the close port 14. Pressurized hydraulic fluid may either be communicated to the open port 12 to actuate the ram 10 to open it and/or keep it open or be communicated to the close port 14 to actuate the ram 10 to close it and/or keep it closed. By way of example only, industry standard BOPs may require up to 3000 psi to close the ram. However, depending on the BOP and tubing being used, the amount of pressure needed to actuate the ram can vary significantly.

Further, the hydraulic circuit 300 may be fluidly coupled to a hydraulic fluid tank (not shown) and a hydraulic fluid pump (not shown) by way of a two position four-way control valve 20. In one or more embodiments, the hydraulic pump may be configured to pump hydraulic fluid from the hydraulic fluid tank up to 3000 psi. However, in one or more embodiments, the hydraulic fluid pump may be configured to pump hydraulic fluid at any pressure as long as the pressure is greater than the pressure needed to close the ram 10 of the BOP. In one or more embodiments, the control valve 20 may be configured to switch between an open position and a close position. When the BOP is open or being opened, the control valve 20 may be configured to be in the open position, and when the BOP is closed or being closed, the control valve 20 may be configured to switch to the close position. In one or more embodiments, when the control valve 20 is in the open position, hydraulic fluid from the hydraulic fluid tank is configured to flow through the open side hydraulic hose 22 and be communicated to the open port 12 of the ram 10. Alternatively, when the control valve 20 is in the close position, hydraulic fluid from the hydraulic fluid tank is configured to flow through the close side hydraulic hose 24 and be communicated to the close port of the ram 10.

In one or more embodiments, the hydraulic circuit 300 may include a first accumulator 310, a second accumulator 320, a hydraulic intensifier 330, a first valve 390, a second valve 340, a third valve 350, a fourth valve 360, a fifth valve 370, and a plurality of hydraulic hoses 380. The first accumulator 310 may be a high pressure accumulator that, when wellbore operations are being run, is filled with pressurized hydraulic fluid, which can be used to quickly communicate pressurized hydraulic fluid to the close port 14 of the ram 10 of the BOP in the event that the ram 10 is closed. In one or more embodiments, the first accumulator 310 may be physically coupled to the BOP such that when closing the BOP, the requisite hydraulic pressure may be provided to the BOP within a required time to meet industry standards. Further, in one or more embodiments, the first accumulator 310 may be an accumulator with a capacity of from about 5 gallons to about 15 gallons. However, in other embodiments, the first accumulator may be any accumulator with a capacity at least 1.5 times the volume of hydraulic flow necessary to close the ram of the BOP which, by way of example, may be 1.9 gallons for a 5.12 inch BOP. Further, while a single accumulator is depicted, instead of a single accumulator, the first accumulator may be a plurality of accumulators of one or more sizes that provide the necessary capacity when each accumulator's capacity is added together.

In one or more embodiments, the first accumulator 310 may be coupled to the hydraulic fluid tank by way of one or more of the plurality of hydraulic hoses 380 and the open side hydraulic hose 22 such that when the control valve 20 is in the open position, hydraulic fluid flows to the first accumulator 310 and fills and pressurizes the first accumulator 310. The hydraulic intensifier 330 may be disposed between the first accumulator 310 and the open side hydraulic hose 22 such that when the control valve 20 is in the open position, hydraulic fluid may flow through the hydraulic intensifier 330 and into the first accumulator 110, but when the control valve 20 is in the close position, hydraulic fluid is prevented from flowing back through the hydraulic intensifier 330. The hydraulic intensifier 330 may increase the pressure of the hydraulic fluid being provided by the hydraulic pump so that the hydraulic fluid stored in the first accumulator 310 is higher than the pressure provided by the hydraulic pump. By way of example only, in one or more embodiments, the pressure of the hydraulic fluid from the hydraulic pump may be 3000 psi, and the hydraulic intensifier may increase the pressure of the hydraulic fluid to 5000 psi. This rise in the pressure of the hydraulic fluid stored in the first accumulator 310 allows the system to communicate sufficient pressure and flow to the close port 14 of the ram 10 so as to ensure that the ram 10 closes within the required time.

Further, in one or more embodiments, in order to increase the pressure of the hydraulic fluid to be provided to the first accumulator 310, the hydraulic intensifier 330 must discharge a volume of hydraulic fluid. This discharged hydraulic fluid is communicated back to the close side hydraulic hose 24 by way of one or more of the plurality of hydraulic hoses 380. To prevent a flow of hydraulic fluid to the discharge side of the hydraulic intensifier 330 when the control valve is in the close position while allowing discharged hydraulic fluid from the hydraulic intensifier to return to the hydraulic circuit 300, the hydraulic circuit 300 may include a first valve 390. In one or more embodiments, the first valve 390 may be a normally closed valve. However, in other embodiments, the first valve 390 may be a check valve, a PO check valve, a counterbalance valve, a hydraulic logic control valve, or a pilot operated directional valve. The first valve may be disposed between the hydraulic intensifier 330 and close side hydraulic hose 24 such that the first valve 390 is open and hydraulic fluid discharged from the hydraulic intensifier 330 may flow through the first valve 390 to the close side hydraulic hose 24 when the control valve 20 is in the open position and the first accumulator 210 is being filled with pressurized hydraulic fluid, and the first valve 390 may be closed when the control valve is in the close position and the close side hydraulic hose is communicating pressurized hydraulic fluid to the close port 14 of the ram 10. In one or more embodiments, the first valve 390 may be fluidly coupled to a hydraulic hose 380 that is coupled to the open side hydraulic hose 22 by way of pilot pressure signal lines such that when the control valve 20 is in the open position, the pressure in the open side hydraulic hose 22 opens the first valve 390. Further, in one or more embodiments, when the control valve 20 is in the close position, the first valve may be configured to return to its default state and close due to the lack of pressure from the open side hydraulic hose 22. Additionally, in one or more embodiments, the hydraulic circuit 300 may include a check valve 392 which is disposed between the first valve 390 and the open side hydraulic hose 22 such that discharged hydraulic fluid may flow from the hydraulic intensifier to the open side hydraulic hose 22 through the check valve 292, but hydraulic fluid is prevented from flowing back form the open side hydraulic hose 22 to the first valve 390.

Furthermore, the first accumulator 310 may be coupled to the close port 14 of the ram 10 of the BOP by way of one or more of the plurality of hydraulic hoses 380 such that when the ram 10 of the BOP is closed, the pressurized hydraulic fluid stored in the first accumulator 310 may be communicated to the close port 14 to close the ram 10. The second valve 340 may be disposed between the first accumulator 310 and the ram 10 of the BOP. When the control valve 20 is in the open position, the second valve 340 may be closed so as to prevent the pressurized hydraulic fluid stored in the first accumulator 310 from being communicated to the close port 14 of the ram 10 and causing the ram 10 to close. Further, when the operator switches the control valve 20 to the close position to close the ram 10 of the BOP, the second valve 340 is opened to allow the pressurized hydraulic fluid stored in the first accumulator 310 to communicate with and provide pressurized hydraulic fluid to the close port 14 of the ram 10. In one or more embodiments, the second valve 340 may be a PO check valve. However, in other embodiments, the second valve 340 may be a counterbalance valve, a hydraulic logic control valve, or a pilot operated directional valve.

In one or more embodiments, the second accumulator 320 may be a low pressure accumulator that, when wellbore operations are being run, is kept empty, but that is able to receive return flow hydraulic fluid from the open port 12 of the ram 10 of the BOP when the control valve 20 is in the close position and the ram 10 is being closed. In one or more embodiments, the second accumulator 320 may be physically coupled to the BOP such that when closing the BOP, the second accumulator may receive return flow of hydraulic fluid from the open port 12 and relieve back pressure on the open port 12. In one or more embodiments, the second accumulator 320 may be an accumulator with a similar capacity to that of the first accumulator. However, as a low pressure accumulator, the second accumulator 320 may be smaller in capacity than the first accumulator 310. Thus, in one or more embodiments, the second accumulator 320 may be an accumulator with a capacity of at least 1 gallon. Furthermore, while a single accumulator is depicted, instead of a single accumulator, the second accumulator may be a plurality of accumulators of one or more sizes that provide a combined capacity of at least 1 gallon.

In one or more embodiments, the second accumulator 320 may be coupled to the open port 12 of the ram 10 of the BOP by way of one or more of the plurality of hydraulic hoses 380 such that when the ram 10 of the BOP is closing, the return flow of hydraulic fluid from the open port 12 of the ram 10 may be communicated to and fill the second accumulator 320 to relieve back pressure on the open port 12 of the ram 10. In one or more embodiments, the second accumulator 320 is coupled to the open port 12 by way of the same one or more of the plurality of hydraulic hoses 380 that couple the open side hydraulic hose 22 to the open port 12 of the ram 10. Further, in one or more embodiments, the third valve 350 may be disposed between the second accumulator 320 and both the ram 10 of the BOP and the open side hydraulic hose 22. Furthermore, the third valve 350 may be configured to be closed when the control valve 20 is in the open position so as to prevent hydraulic fluid from flowing to the second accumulator 220 and may be configured to be open when the control valve 20 is in the close position so as to allow hydraulic fluid to flow to the second accumulator 320. In one or more embodiments, the third valve 350 may be a PO check valve. However, in other embodiments, the third valve 350 may be a counterbalance valve, a hydraulic logic control valve, or a pilot operated directional valve. While a second accumulator is illustrated, in one or more embodiments, instead of using a second accumulator, a hydraulic hose of large diameter may be run directly from the third valve 350 to the hydraulic fluid tank to relieve back pressure on the open port 12 of the ram 10. Further, in one or more embodiments, the third valve need not be included either and the hydraulic hose of large diameter may be run directly from the open port 12 to the hydraulic fluid tank to relieve back pressure.

Further, the second accumulator 320 may be coupled to the hydraulic fluid tank by way of one or more of the plurality of hydraulic hoses 380 and the close side hydraulic hose 24 such that hydraulic fluid in the second accumulator 320 may be vented off. In one or more embodiments, the second accumulator 320 may begin venting off hydraulic fluid when the control valve 20 is in the close position after the ram 10 has finished closing, and the second accumulator 320 may vent off any remaining hydraulic fluid when the control valve is switched back to the open position, thus emptying the second accumulator 320. The fourth valve 360 may be disposed between the second accumulator 320 and the close side hydraulic hose 24 such that hydraulic fluid may flow through fourth valve 360 from the second accumulator 320 to the close side hydraulic hose 24 but is prevented from flowing from the close side hydraulic hose 24 back to the second accumulator 320. In one or more embodiments, the fourth valve 360 may be a PO check valve. However, in other embodiments, the fourth valve 360 may be a counterbalance valve, a hydraulic logic control valve, or a pilot operated directional valve.

Additionally, in one or more embodiments, because the hydraulic fluid stored in the first accumulator 310 is amplified above the working pressure of the BOP, which is the pressure at which the BOP operates to close the ram, the hydraulic circuit 300 may include a fifth valve 370 to prevent over-pressurization at the ram 10. In one or more embodiments, the fifth valve 370 may be a pressure reducing valve, a pressure reducing/relieving valve, or a pilot operated directional valve. The fifth valve may be coupled between the first accumulator 310 and the second valve 340 and may be configured to limit the pressure of the hydraulic fluid passing through the fifth valve 370 to a preset pressure. In one or more embodiments, the preset pressure may be greater than the minimum pressure necessary to close the ram 10 but lower than a pressure that would cause over-pressurization at the close port 14. When the control valve 20 is in the open position, the fifth valve 370 may be held fully open. Further, when the control valve 20 is in the close position and the second valve 340 is open, hydraulic fluid is communicated from the first accumulator 310 to the close port 14 of the ram 10 through the fifth valve 370. While the pressure of hydraulic fluid between the fifth valve 370 and the close port 14 is below the preset pressure of the fifth valve 370, the fifth valve 370 remains open. However, when the pressure of hydraulic fluid between the fifth valve 370 and the close port rises above the preset pressure, the fifth valve 370 closes so as to limit the pressure acting on the close port 14 of the ram 10.

Further, in one or more embodiments, the hydraulic system 300 may further include a first safety relief valve 394, a second safety relief valve 396, and a manually-operated open/close valve 398. In one or more embodiments, the first safety relief valve 394 may be coupled between the open side hydraulic hose 22 and the close side hydraulic hose 24, either directly or indirectly by way of one or more of the plurality of hydraulic hoses 380, such that if pressure in the open side hydraulic hose 22 exceeds a predetermined pressure, the first safety relief valve 394 opens to relieve pressure and prevent over-pressurization at the open port 12 of the ram 10. Similarly, in one or more embodiments, the second safety relief valve 396 may be coupled between the close side hydraulic hose 24 and the open side hydraulic hose 22, either directly or indirectly by way of one or more of the plurality of hydraulic hoses 380, such that if pressure in the close side hydraulic hose 24 exceeds a predetermined pressure, the second safety relief valve 296 opens to relieve pressure and prevent over-pressurization at the close port 14 of the ram 10. In one or more embodiments, the first safety relief valve 394 and the second safety relief valve 396 may be a direct-acting, normally closed, pressure-limiting valve. However, the first safety relief valve 394 and the second safety relief valve 396 may be any valve that is set to open at a predetermined pressure in order to prevent over-pressurization of the hydraulic system 300. Additionally, by way of example only, in one or more embodiments, the predetermined pressure, at which the first safety relief valve 394 and the second safety relief valve 396 are set to open, may be set at 3300 psi.

Additionally, the manually-operated open/close valve 298 may be coupled between the first accumulator 210 and the close side hydraulic hose 14, and in the default position, may be closed. In one or more embodiments, if pressure needs to be relieved from the first accumulator without closing the ram 10 of the BOP or having already closed the ram 10 of the BOP, pressure may be bled from the first accumulator 210 by slowly, partially opening the manually-operated open/close valve 298.

Figure 4:
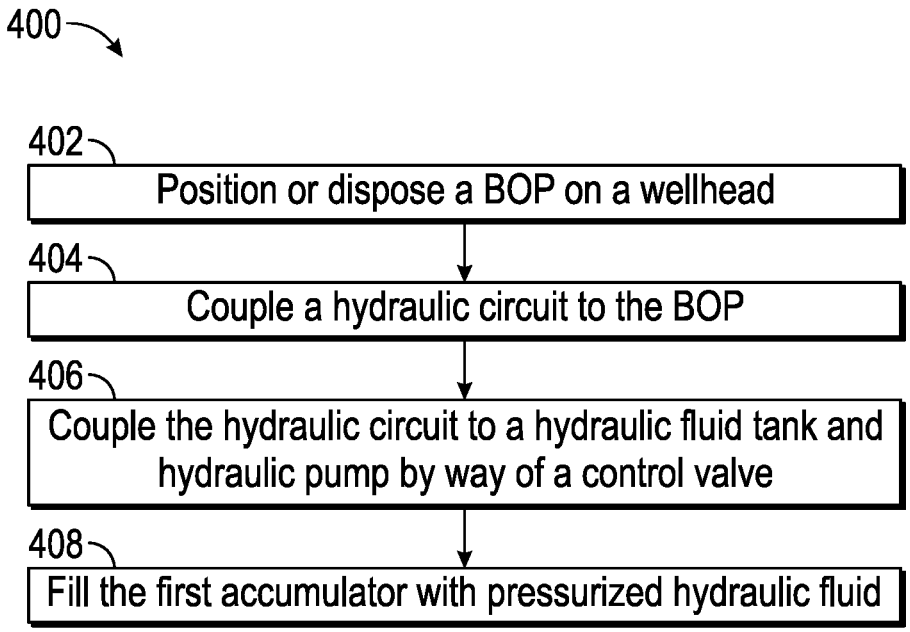
FIG. 4 is a flow chart illustrating a method for sealing a wellbore according to one or more aspects of the present disclosure.

FIG. 4 is a flow chart illustrating a method 400 for preparing a BOP closing circuit according to one or more aspects of the present disclosure. At step 402, a BOP having a ram 10 is positioned or disposed on a wellhead. In one or more embodiments, when the BOP is positioned or disposed on a wellhead, the ram 10 may be open such that tubing and other wellbore operations equipment may be run through the BOP.

At step 404, a hydraulic circuit 100, 200, 300 may be coupled to the BOP. Coupling the hydraulic circuit 100, 200, 300 to the BOP may include coupling a first hydraulic hose of the plurality of hydraulic hoses 180, 280, 380 of the hydraulic circuit 100, 200, 300 to the open port 12 and coupling a second hydraulic hose of the plurality of hydraulic hoses 180, 280, 380 of the hydraulic circuit 100, 200, 300 to the close port 14 of the ram 10 of the BOP. Further, at step 406, the hydraulic circuit 100, 200, 300 may be coupled to a hydraulic fluid tank and hydraulic pump by way of a control valve 20. Coupling the hydraulic circuit 100, 200, 300 to the hydraulic fluid tank and hydraulic pump may include coupling the first hydraulic hose of the plurality of hydraulic hoses 180, 280, 380 of the hydraulic circuit 100, 200, 300 to the open side hydraulic hose 22 and coupling the second hydraulic hose of the plurality of hydraulic hoses 180, 280, 380 of the hydraulic circuit 100, 200, 300 to the close side hydraulic hose 24. In one or more embodiments, the first hydraulic hose of the plurality of hydraulic hoses may be coupled to the first valve 130 of the hydraulic circuit 100. In other embodiments, the first hydraulic hose of the plurality of hoses may be coupled to the hydraulic intensifier 230, 330 of the hydraulic circuit 200, 300.

At step 408, a first accumulator 110, 210, 310 of the hydraulic circuit 100, 200, 300 may be filled with pressurized hydraulic fluid. In one or more embodiments, filling the first accumulator 110, 210, 310 of the hydraulic circuit 100, 200, 300 may include switching the control valve 20 to an open position and pumping hydraulic fluid from the hydraulic fluid tank into the hydraulic circuit 100, 200, 300 using the hydraulic pump. In one or more embodiments, filling the first accumulator 110 may include pumping the hydraulic fluid through a first valve 130 until the first accumulator 110 is filled with hydraulic fluid pressurized to the pressure provided by the hydraulic pump. In other embodiments, filling the first accumulator 200, 300 may include pumping the hydraulic fluid through a hydraulic intensifier 230, 330 to raise the pressure of the hydraulic fluid to be stored in the first accumulator 210, 310 until the first accumulator 210, 310 is filled with hydraulic fluid pressurized above the pressure provided by the hydraulic pump.

Further, in one or more embodiments, after the BOP closing circuit is prepared, a tubular component may be lowered through the BOP. In one or more embodiments, the tubular may be lowered through the BOP as part of wellbore operations including drilling operations, sand removal or cleanout operations, plug drill out or removal operations, casing perforation operations, acid pumping operations, well logging operations, fracking operations, injections string installation operations, cementing operations, or gravel packing operations.

Furthermore, in one or more embodiments, after the BOP closing circuit is prepared, the ram 10 of the BOP may be closed. In one or more embodiments, during wellbore operations, if an operator determines that the wellbore needs to be sealed, the operator may close the ram 10 of the BOP. The operator may determine that the wellbore needs to be closed for any number of reasons, including if signs are detected that a blowout may occur, a fire occurs at the wellsite, or there is a wellsite or wellbore equipment failure. Further, by way of example only, signs that a blowout may occur may include drilling fluid return rates increasing while the drilling fluid pumps continue to operate at their normal speed, drilling fluid continuing to return even when drilling fluid pumps are turned off, drilling fluid stopping to flow into the wellbore while mud levels in the well continue to climb, the amount of mud present in the wellbore increasing in volume by an amount greater than the volume of a drilling pipe when the drilling pipe is removed from the wellbore, drilling pump stroke increasing while the drilling pump pressure decreases, the density of drilling mud decreasing as additional fluid flows into the wellbore, or the drill suddenly moving faster or dropping to a surprising depth which indicates a pocket of fluid or gas that could lead to a kick.

In one or more embodiments, closing the ram 10 of the BOP may include switching the control valve to the close position and pumping hydraulic fluid from the hydraulic fluid tank into the hydraulic circuit 100, 200, 300 using the hydraulic pump. Further, closing the ram 10 of the BOP may include opening the second valve 140, 240, 340 such that fluid from the first accumulator 110, 210, 310 may communicate to the close port 14 of the ram 10. Furthermore, closing the ram 10 of the BOP may include opening the third valve 150, 250, 350 such that hydraulic fluid may flow into the second accumulator 120, 220, 320. Additionally, in one or more embodiments, closing the ram 10 of the BOP may include closing a fifth valve 270 when hydraulic pressure at the close port 14 of the ram 10 reaches a predetermined pressure. As discussed above, the predetermined pressure may be set at any pressure greater than or equal to the pressure required to close the ram 10, and in one or more embodiments, may be set at 2900 psi-3000 psi.

According to one or more aspects of the present disclosure, the hydraulic circuit provides an efficient and cost-effective system for closing a ram of a BOP in order to close a well. The hydraulic circuit according to one or more aspects of the present disclosure reduces the amount of time needed to close the ram of the BOP such that the ram of the BOP may be closed within the industry defined required time and can be incorporated into existing systems to eliminate the need to replace BOPs and hydraulic circuitry already being used in the field. By reducing the amount of time needed to provide the pressure necessary to close the ram and by reducing the back pressure on the ram, performance of the BOP is improved with minimal cost or decrease in productivity.

An embodiment of the present disclosure is a system including: a BOP; a hydraulic fluid tank; a hydraulic fluid pump; a control valve; and a hydraulic circuit. The BOP includes a ram having a close port and an open port. The hydraulic fluid pump is coupled to the hydraulic fluid tank and the blowout preventer, and the hydraulic fluid pump is configured to pump a hydraulic fluid from the hydraulic fluid tank to the blowout preventer. The control valve is coupled to the open port of the ram, the close port of the ram, and the hydraulic fluid tank. The control valve is configured to switch between an open position in which the hydraulic fluid from the hydraulic fluid tank is directed to the open port and a close position in which the hydraulic fluid from the hydraulic fluid tank is directed to the close port. The hydraulic circuit is coupled to the control valve and the blowout preventer, and the hydraulic circuit includes: a first accumulator; a first valve; and a second valve. The first accumulator is coupled to the control valve and the close port of the ram. The first valve is disposed between the first accumulator and the control valve. The first valve is configured to allow the hydraulic fluid to flow from the control valve to the first accumulator, and the first valve is configured to prevent the hydraulic fluid from flowing back from the first accumulator to the control valve. The second valve is disposed between the first accumulator and the close port of the ram. When the control valve is in the open position, the second valve is closed, and when the control valve is in the close position, the second valve is open.

In one or more embodiments described in the preceding paragraph, the ram is configured to open when a hydraulic fluid is provided to the open port, and the ram is configured to close when the hydraulic fluid is provided to the close port. In one or more embodiments described in the preceding paragraph, the control valve is coupled to the open port of the ram of the blowout preventer by an open side hydraulic hose, and the control valve is coupled to the close port of the ram of the blowout preventer by a close side hydraulic hose. In one or more embodiments described in the preceding paragraph, the first accumulator is coupled to the open side hydraulic hose, and when the control valve is in the open position, the first accumulator is configured to receive the hydraulic fluid. In one or more embodiments described in the preceding paragraph, when the control valve is in the close position, the first accumulator is configured to communicate the hydraulic fluid to the close port of the ram. In one or more embodiments described in the preceding paragraph, the hydraulic circuit further includes: a second accumulator, wherein the second accumulator is coupled to the open port of the ram of the blowout preventer, and wherein when the control valve is in the close position, the second accumulator is configured to receive the hydraulic fluid from the open side hydraulic hose; and a third valve, wherein the third valve is disposed between the second accumulator and the open port of the ram, wherein when the control valve is in the open position, the third valve is closed, and wherein when the control valve is in the close position, the third valve is open. In one or more embodiments described in the preceding paragraph, the control valve is coupled to the close port of the ram of the blowout preventer by a close side hydraulic hose and the second accumulator is further coupled to the close side hydraulic hose, and when the control valve is in the open position, the second accumulator is configured to vent off the hydraulic fluid within the second accumulator. Further, the hydraulic circuit further includes a fourth valve, wherein the fourth valve is disposed between the second accumulator and the close side hydraulic hose, wherein the fourth valve is configured to allow the hydraulic fluid to flow from the second accumulator to the close side hydraulic hose, and wherein the fourth valve is configured to prevent the hydraulic fluid from flowing back from the close side hydraulic hose to the second accumulator. In one or more embodiments described in the preceding paragraph, the hydraulic circuit further includes a fifth valve, wherein the fifth valve is disposed between the first accumulator and the close port of the ram, wherein the fifth valve is configured to allow the hydraulic fluid to flow from the first accumulator to the close port of the ram, and wherein the fifth valve is configured to prevent the hydraulic fluid from flowing back from the close port of the ram to the first accumulator. In one or more embodiments described in the preceding paragraph, the hydraulic circuit further includes a hydraulic hose coupled between the open port of the ram and the hydraulic fluid tank. In one or more embodiments described in the preceding paragraph, the first valve is one of a pilot operated check valve, a counterbalance valve, a hydraulic logic control valve, or a pilot operated directional valve, and the second valve is one of a pilot operated check valve, a counterbalance valve, a hydraulic logic control valve, or a pilot operated directional valve.

Another embodiment of the present disclosure is a method including: positioning a blowout preventer on a wellhead; coupling a hydraulic circuit to the blowout preventer; coupling the hydraulic circuit to a hydraulic fluid tank and a hydraulic fluid pump by way of a control valve; and filling the first accumulator with the hydraulic fluid. The blowout preventer includes a ram having a close port and an open port. Further, the control valve includes an open side hydraulic hose and a close side hydraulic hose. Additionally, the hydraulic circuit includes: a first accumulator; a first valve; and a second valve. The first accumulator is configured to fill with a hydraulic fluid when the control valve is in an open position and is configured to provide the hydraulic fluid to the close port when the control valve is in a close position. The first valve is disposed between the first accumulator and the open side hydraulic hose. Further, the first valve is configured to allow the hydraulic fluid to flow from the open side hydraulic hose to the first accumulator and is configured to prevent the hydraulic fluid from flowing back from the first accumulator to the open side hydraulic hose. The second valve is disposed between the first accumulator and the close port of the ram. When the control valve is in the open position, the second valve is closed, and when the control valve is in the close position, the second valve is open.

In one or more embodiments described in the preceding paragraph, the hydraulic circuit further includes a plurality of hydraulic hoses, and coupling the hydraulic circuit to the blowout preventer includes: coupling a first hydraulic hose of the plurality of hydraulic hoses to the open port of the ram; and coupling a second hydraulic hose of the plurality of hydraulic hoses to the close port of the ram. In one or more embodiments described in the preceding paragraph, coupling the hydraulic circuit to the hydraulic fluid tank and the hydraulic fluid pump by way of the control valve further includes: coupling the first hydraulic hose of the plurality of hydraulic hoses to the open side hydraulic hose; and coupling the second hydraulic hose of the plurality of hydraulic hoses to the close side hydraulic hose. In one or more embodiments described in the preceding paragraph, the first hydraulic hose of the plurality of hydraulic hoses is coupled to the first valve, and the second hydraulic hose of the plurality of hydraulic hoses is coupled to the second valve. In one or more embodiments described in the preceding paragraph, filling the first accumulator with the hydraulic fluid includes: switching the control valve to an open position, wherein in the open position, the hydraulic fluid flows through the open side hydraulic hose; and pumping the hydraulic fluid from the hydraulic fluid tank into the hydraulic circuit using the hydraulic pump. In one or more embodiments described in the preceding paragraph, filling the first accumulator with the hydraulic fluid further includes: pumping the hydraulic fluid through the first valve until the first accumulator is filled with the hydraulic fluid. In one or more embodiments described in the preceding paragraph, the method further includes: lowering a tubular component through the blowout preventer; and closing the ram of the blowout preventer. In one or more embodiments described in the preceding paragraph, closing the ram of the blowout preventer includes: switching the control valve to a close position, wherein in the close position, the hydraulic fluid flows through the close side hydraulic hose; pumping the hydraulic fluid from the hydraulic fluid tank into the hydraulic circuit using the hydraulic pump; and opening the second valve such that the hydraulic fluid from the first accumulator communicates to the close port of the ram. In one or more embodiments described in the preceding paragraph, the hydraulic circuit further includes: a second accumulator, wherein the second accumulator is coupled to the open port of the ram of the blowout preventer; and a third valve, wherein the third valve is disposed between the second accumulator and the open port of the ram, wherein when the control valve is in the open position, the third valve is closed, and wherein when the control valve is in the close position, the third valve is open. Further, closing the ram of the blowout preventer further includes: opening the third valve such that the hydraulic fluid flows into the second accumulator from the open port of the ram.

The present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The disclosure illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A system, comprising:

a blowout preventer, wherein the blowout preventer includes a ram having a close port and an open port;

a hydraulic fluid tank;

a hydraulic fluid pump coupled to the hydraulic fluid tank and the blowout preventer, wherein the hydraulic fluid pump is configured to pump a hydraulic fluid from the hydraulic fluid tank to the blowout preventer;

a control valve coupled to the open port of the ram, the close port of the ram, and the hydraulic fluid tank, wherein the control valve is configured to switch between an open position in which the hydraulic fluid from the hydraulic fluid tank is directed to the open port and a close position in which the hydraulic fluid from the hydraulic fluid tank is directed to the close port; and a hydraulic circuit coupled to the control valve and the blowout preventer, wherein the hydraulic circuit comprises:

a first accumulator, wherein the first accumulator is coupled to the control valve and the close port of the ram;

a first valve, wherein the first valve is disposed between the first accumulator and the control valve, wherein the first valve is configured to allow the hydraulic fluid to flow from the control valve to the first accumulator, and wherein the first valve is configured to prevent the hydraulic fluid from flowing back from the first accumulator to the control valve; and a second valve, wherein the second valve is disposed between the first accumulator and the close port of the ram, wherein when the control valve is in the open position, the second valve is closed, and wherein when the control valve is in the close position, the second valve is open.

2. The system of claim 1, wherein the ram is configured to open when a hydraulic fluid is provided to the open port, and wherein the ram is configured to close when the hydraulic fluid is provided to the close port.

3. The system of claim 1, wherein the control valve is coupled to the open port of the ram of the blowout preventer by an open side hydraulic hose, wherein the control valve is coupled to the close port of the ram of the blowout preventer by a close side hydraulic hose.

4. The system of claim 3, wherein the first accumulator is coupled to the open side hydraulic hose, and wherein when the control valve is in the open position, the first accumulator is configured to receive the hydraulic fluid.

5. The system of claim 1, wherein when the control valve is in the close position, the first accumulator is configured to communicate the hydraulic fluid to the close port of the ram.

6. The system of claim 1, wherein the hydraulic circuit further comprises:

a second accumulator, wherein the second accumulator is coupled to the open port of the ram of the blowout preventer, and wherein when the control valve is in the close position, the second accumulator is configured to receive the hydraulic fluid from the open side hydraulic hose; and a third valve, wherein the third valve is disposed between the second accumulator and the open port of the ram, wherein when the control valve is in the open position, the third valve is closed, and wherein when the control valve is in the close position, the third valve is open.

7. The system of claim 6, wherein:

The control valve is coupled to the close port of the ram of the blowout preventer by a close side hydraulic hose;

the second accumulator is further coupled to the close side hydraulic hose;

when the control valve is in the open position, the second accumulator is configured to vent off the hydraulic fluid within the second accumulator; and the hydraulic circuit further comprises:

a fourth valve, wherein the fourth valve is disposed between the second accumulator and the close side hydraulic hose, wherein the fourth valve is configured to allow the hydraulic fluid to flow from the second accumulator to the close side hydraulic hose, and wherein the fourth valve is configured to prevent the hydraulic fluid from flowing back from the close side hydraulic hose to the second accumulator.

8. The system of claim 1, wherein the hydraulic circuit further comprises:

a fifth valve, wherein the fifth valve is disposed between the first accumulator and the close port of the ram, wherein the fifth valve is configured to allow the hydraulic fluid to flow from the first accumulator to the close port of the ram, and wherein the fifth valve is configured to prevent the hydraulic fluid from flowing back from the close port of the ram to the first accumulator.

9. The system of claim 1, wherein the hydraulic circuit further comprises:

a hydraulic hose coupled between the open port of the ram and the hydraulic fluid tank.

10. The system of claim 1, wherein:

the first valve is one of a pilot operated check valve, a counterbalance valve, a hydraulic logic control valve, or a pilot operated directional valve; and the second valve is one of a pilot operated check valve, a counterbalance valve, a hydraulic logic control valve, or a pilot operated directional valve.

11. A method, comprising:

positioning a blowout preventer on a wellhead, wherein the blowout preventer comprises a ram having a close port and an open port;

coupling a hydraulic circuit to the blowout preventer;

coupling the hydraulic circuit to a hydraulic fluid tank and a hydraulic fluid pump by way of a control valve, wherein the control valve comprises an open side hydraulic hose and a close side hydraulic hose, and wherein the hydraulic circuit comprises:

a first accumulator configured to fill with a hydraulic fluid when the control valve is in an open position and configured to provide the hydraulic fluid to the close port when the control valve is in a close position;

a first valve, wherein the first valve is disposed between the first accumulator and the open side hydraulic hose, wherein the first valve is configured to allow the hydraulic fluid to flow from the open side hydraulic hose to the first accumulator, and wherein the first valve is configured to prevent the hydraulic fluid from flowing back from the first accumulator to the open side hydraulic hose; and a second valve, wherein the second valve is disposed between the first accumulator and the close port of the ram, wherein when the control valve is in the open position, the second valve is closed, and wherein when the control valve is in the close position, the second valve is open; and filling the first accumulator with the hydraulic fluid.

12. The method of claim 11, wherein:

the hydraulic circuit further comprises a plurality of hydraulic hoses; and coupling the hydraulic circuit to the blowout preventer comprises:

coupling a first hydraulic hose of the plurality of hydraulic hoses to the open port of the ram; and coupling a second hydraulic hose of the plurality of hydraulic hoses to the close port of the ram.

13. The method of claim 12, wherein coupling the hydraulic circuit to the hydraulic fluid tank and the hydraulic fluid pump by way of the control valve further comprises:

coupling the first hydraulic hose of the plurality of hydraulic hoses to the open side hydraulic hose; and coupling the second hydraulic hose of the plurality of hydraulic hoses to the close side hydraulic hose.

14. The method of claim 13, wherein:

the first hydraulic hose of the plurality of hydraulic hoses is coupled to the first valve; and the second hydraulic hose of the plurality of hydraulic hoses is coupled to the second valve.

15. The method of claim 12, wherein:

the first hydraulic hose of the plurality of hydraulic hoses is coupled to the first valve; and the second hydraulic hose of the plurality of hydraulic hoses is coupled to the second valve.

16. The method of claim 11, wherein filling the first accumulator with the hydraulic fluid comprises:

switching the control valve to an open position, wherein in the open position, the hydraulic fluid flows through the open side hydraulic hose; and pumping the hydraulic fluid from the hydraulic fluid tank into the hydraulic circuit using the hydraulic pump.

17. The method of claim 16, wherein filling the first accumulator with the hydraulic fluid further comprises:

pumping the hydraulic fluid through the first valve until the first accumulator is filled with the hydraulic fluid.

18. The method of claim 11, further comprising:

lowering a tubular component through the blowout preventer; and closing the ram of the blowout preventer.

19. The method of claim 18, wherein closing the ram of the blowout preventer comprises:

switching the control valve to a close position, wherein in the close position, the hydraulic fluid flows through the close side hydraulic hose;

pumping the hydraulic fluid from the hydraulic fluid tank into the hydraulic circuit using the hydraulic pump; and opening the second valve such that the hydraulic fluid from the first accumulator communicates to the close port of the ram.

20. The method of claim 19, wherein:

the hydraulic circuit further comprises:

a second accumulator, wherein the second accumulator is coupled to the open port of the ram of the blowout preventer; and a third valve, wherein the third valve is disposed between the second accumulator and the open port of the ram, wherein when the control valve is in the open position, the third valve is closed, and wherein when the control valve is in the close position, the third valve is open; and closing the ram of the blowout preventer further comprises:

opening the third valve such that the hydraulic fluid flows into the second accumulator from the open port of the ram.

* * * * *